United States Patent [19]

Camp et al.

[11] Patent Number: 4,496,632

[45] Date of Patent: Jan. 29, 1985

[54] PROCESS FOR LUBRICATING SYNTHETIC FIBERS

[75] Inventors: Ronald L. Camp, Riverview; Edward M. Dexheimer; Basil Thir, both of Grosse Ile, all of Mich.

[73] Assignee: BASF Wyandotte Corporation, Wyandotte, Mich.

[21] Appl. No.: 450,173

[22] Filed: Dec. 16, 1982

[51] Int. Cl.[3] ..... B32B 27/34; C10M 1/20

[52] U.S. Cl. ..... 428/395; 428/375; 252/52 R; 252/52 A

[58] Field of Search ..... 428/367, 395, 394, 375; 252/52 R, 52 A, 8.9; 427/389.8, 389.9

[56] References Cited

U.S. PATENT DOCUMENTS

| | | | |
|---|---|---|---|
| 2,520,611 | 8/1950 | Roberts et al. | 568/613 |
| 2,520,612 | 8/1950 | Roberts et al. | 568/613 |
| 2,782,240 | 2/1957 | Hefner et al. | 568/608 |
| 3,850,682 | 11/1975 | Sturwold et al. | 428/395 |
| 3,859,122 | 1/1975 | Burks, Jr. et al. | 428/395 |
| 3,925,589 | 12/1975 | Sturwold et al. | 428/395 |
| 3,959,391 | 5/1976 | Allain | 568/619 |
| 3,959,560 | 5/1976 | Sturwold et al. | 428/394 |
| 4,094,797 | 6/1978 | Newkirk et al. | 252/8.9 |
| 4,113,649 | 9/1978 | Lehmkuhl et al. | 252/363.5 |
| 4,127,490 | 12/1978 | Newkirk et al. | 252/52 A |
| 4,165,405 | 8/1979 | Login et al. | 428/395 |
| 4,245,004 | 1/1981 | Login et al. | 428/395 |
| 4,288,639 | 9/1981 | Camp | 68/625 |
| 4,301,083 | 11/1981 | Yoshimura et al. | 260/404 |
| 4,308,402 | 12/1981 | Edwards et al. | 568/618 |
| 4,361,623 | 11/1982 | Newkirk et al. | 428/394 |

*Primary Examiner*—George F. Lesmes
*Assistant Examiner*—Beverly K. Johnson
*Attorney, Agent, or Firm*—Bernhard R. Swick

[57] ABSTRACT

Relates to lubricating thermoplastic synthetic fibers comprising the application to said fibers of a modified polyoxyalkylene polyol which polyol is modified by capping all of the hydroxyl groups with benzyl, aryl, substituted benzyl or aryl groups or alkyl groups having 1 to 4 carbon atoms.

27 Claims, No Drawings

PROCESS FOR LUBRICATING SYNTHETIC FIBERS

BACKGROUND OF THE INVENTION

1. Field of the Invention

This invention relates to a process for lubricating synthetic fibers such as mono- and multi-filament polyester, nylon, polyolefin, poly(benzimidazole), carbon and glass yarn.

2. Description of the Prior Art

The conversion of nylon, polyester, polyolefin, poly(-benzimidazole), carbon or glass fibers into useful yarn for textile manufacture requires the use of a lubricant formulation called the "fiber finish" or "spin finish." The spin finish must control the yarn-to-metal friction to protect the newly spun fiber from fusion or breaks and, in the case of texturing, to insure that proper twist is transferred to the yarn. In general, typical apparatus for spinning synthetic fibers includes many parts of polyurethane elastomers. In the past, high viscosity products have been employed as spin finish components for high-speed texturing of polyester or nylon. However, in recent years, demand for the high viscosity products has slackened, and the fiber and yarn manufacturers are searching for low viscosity fiber finishes.

It is known to use polyoxyalkylene compounds such as block and heteric polymers of ethylene oxide and propylene oxide as spin finishes for the production of synthetic yarns. However, such products generally are characterized by interacting with the polyurethane elastomers used in the fiber processing machinery with resulting swelling, softening and other detrimental effects. Such products often are difficult to emulsify in conventional spin finishes. Also, they are characterized by high viscosity.

References of Interest

| U.S. Pat. No. | Issued | Inventor(s) |
|---|---|---|
| 4,288,639 | 9/8/81 | Camp |
| 2,520,611 | 8/29/50 | Roberts et al |
| 2,520,612 | 8/29/50 | Roberts et al |
| 2,782,240 | 2/19/57 | Hefner et al |
| 3,959,391 | 5/25/76 | Allain |
| 4,113,649 | 9/12/78 | Lehmkuhl et al |
| 4,301,083 | 11/17/81 | Yoshimura et al |
| 4,308,402 | 12/29/81 | Edwards et al |
| 4,094,797 | 6/13/78 | Newkirk et al |
| 4,165,405 | 8/21/79 | Login et al |

U.S. Pat. Application Serial No. 441,494, filed November 15, 1982.

SUMMARY OF THE INVENTION

The instant invention relates to a process for lubricating synthetic textile fibers such as polyester, nylon, poly(benzimidazole), carbon and glass fibers utilizing a modified polyoxyalkylene polyol. This polyol is modified by capping all hydroxyl groups with one or more groups selected from benzyl, aryl, substituted benzyl, substituted aryl and alkyl groups having 1 to 4 carbon atoms. This modified polyol can be applied, if desired, without dilution in water since the lubricant has considerably reduced viscosity at ambient temperatures as compared to compositions of the prior art utilized for this purpose. However, since only a small amount is actually needed, generally it is preferred to dilute the modified polyol with water or conventional organic solvent in the interest of economy. Generally the fiber lubricant contains from about 0.5 to 100 percent by weight of the modified polyoxyalkylene polyol. Unexpectedly, the use of this modified polyoxyalkylene polyol provide a unique combination of low viscosity improved emulsification and the property of not swelling or otherwise interacting with polyurethane elastomers used in fiber processing machinery. It is believed that these advantages are obtained as a result of the capping of the terminal hydroxyls of the polyols employed in the processes of the prior art.

DESCRIPTION OF THE PREFERRED EMBODIMENT

In a preferred embodiment of the instant invention, the modified polyoxyalkylene polyol employed in the lubrication process of the instant invention can be obtained by modifying a conventinal polyoxyalkylene polyol by capping all the hydroxyl groups of the polyol with benzyl, aryl, substituted benzyl, substituted aryl groups or alkyl groups having 1 to 4 carbon atoms. The conventional polyoxyalkylene polyol can be an ethylene oxide, propylene oxide or butylene oxide homopolymer or a heteric or block copolymer of ethylene oxide and at least one lower alkylene oxide having 3 to 4 carbon atoms. In a preferred embodiment, the ethylene oxide, constitutes at least about 10 percent by weight based on the total weight of the polyoxyalkylene polyol. In a most preferred embodiment about 10 to 80 percent by weight ethylene oxide is utilized with about 90 to 20 percent by weight of the lower alkylene oxide having 3 to 4 carbon atoms.

The conventional polyether polyols which are capped to produce the lubricant employed in the process in this invention are generally prepared utilizing an active hydrogen-containing compound having 1, 2, 3 or more active hydrogens in the presence of an acidic or basic oxyalkylation catalyst and optionally an inert organic solvent at elevated temperatures in the range of about 100° C. to 150° C. under an inert gas pressure generally from about 20 to about 100 pounds per square inch gauge. As an initiator, the compound containing an active hydrogen can be any compound containing at least one OH group, preferably an alkyl, aryl or arylalkyl alcohol, and most preferably an alkyl or arylalkyl compound, all with about 1 to 18, preferably about 1 to 12, and most preferably about 1 to 6 carbon atoms in the alkyl chain. Suitable initiators are selected from any compounds containing one or more OH groups having about 1 to 18 carbons and include aliphatic monofunctional alcohols. These can be used either alone or in mixtures. Representative alcohols include methyl, ethyl, propyl, butyl, amyl, hexyl, heptyl, octyl, nonyl, decyl, dodecyl, tetradecyl, cetyl and corresponding secondary and tertiary alcohols and mixtures thereof. Representative aryl initiators include phenol, cresol, xylol, octylphenol, and nonylphenol. Preparation of suitable polyoxylalkylene polyols is disclosed in U.S. Pat. Nos. 2,674,619; 2,677,700; 3,036,118; 2,828,345; 4,326,977, 2,425,755; British Pat. No. 722,746 and *Block and Graft Copolymerization,* vol. 2, edited by R. J. Ceresa, pages 68 and 69, John Wiley & Sons copyright 1976.

The lubricants employed in the process of the invention can be prepared by further reacting a polyoxyalkylene polyol, as described above, having a molecular weight of about 500 to 15,000, preferably about 800 to 5,000, with an alkylating or substituted or unsubstituted benzylating or arylating agent so as to provide an alkyl, subsituted or unsubstituted benzyl or substituted or unsubstituted aryl cap on the polyoxyalkylene polyol. The substituted benzyl or aryl groups may include as substituents 1 to 10 carbon atom alkyl groups and halogens. Further details of the preparation of the benzyl, aryl or alkyl modified polyoxylalkylene polyol lubricants employed in the process of the instant invention can be obtained from U.S. Pat. Nos. 4,301,083; 4,308,402; 4,113,649; 2,520,611 and 2,520,612 incorporated herein by reference. As used herein, the expression "benzyl, aryl" includes both substituted and unsubstituted benzyl and aryl groups.

The polyoxyalkylene polyol capped with a benzyl, aryl or $C_1$ to $C_4$ alkyl group is believed to have the following generalized formula:

$$R(A)_mOR$$

wherein A is an oxyalkylene group selected from oxyethylene, oxypropylene, oxybutylene, oxytetramethylene and heteric and block mixtures thereof; m is a whole number selected to give an overall average molecular weight of the product of 500 to 15,000, R is selected from the group consisting of benzyl, aryl, substituted benzyl, substituted aryl and $C_1$ to $C_4$ aliphatic groups and wherein the R groups may be the same or different.

In a preferred embodiment A comprises oxyethylene groups and groups selected from oxypropylene and oxybutylene. In a most preferred formula the oxypropylene or oxybutylene groups are centrally located with oxyethylene groups attached at each end thereof. The benzyl, aryl or alkyl caps are attached to the ends of the oxyethylene groups opposite the oxypropylene or oxybutylene groups. In another most preferred embodiment the oxyethylene groups are centrally located in the molecule and the oxypropylene or oxybutylene groups are attached at opposite ends of the oxyethylene groups. The benzyl, aryl or alkyl caps are attached to the ends of the oxypropylene or oxybutylene groups opposite the ends attached to the oxyethylene groups. For use in the process of the instant invention, the above described capped polyoxyalkylene polyol product may be used alone or in admixture with other fiber lubricants or with water or conventional solvents and/or other additives.

The benzyl, aryl or $C_1$ to $C_4$ alkyl capped polyoxyalkylene polyol compositions can be prepared in accordance with the prior art, all as set forth above.

The fact that the terminal hydroxyl group(s), present in analogous compounds of the prior art is capped with a benzyl, aryl or $C_1$ to $C_4$ alkyl grup and thus is no longer available as a site for hydrogen bonding results in a product at a comparable molecular weight having a significantly reduced viscosity as measured at ambient temperature and, most important, does not react with the polyurethane elastomers employed in fiber processing machinery. Thus, the lubricants employed in the process of the instant invention which do not contain terminal hydroxyl groups but rather are terminated with benzyl, aryl or $C_1$ to $C_4$ alkyl groups are thus when employed in the lubrication process of the instant invention superior to processes employing lubricants of the prior art. More specifically, products having a higher molecular weight can be obtained without a concurrent viscosity increase and products which do not interact or attack the polyurethane elastomers used in fiber processing machinery may be achieved. As previously stated, the modified polyoxyalkylene polyol may be applied in an aqueous or conventional organic solvent solution containing about 0.5 to 100 percent by weight of said modified polyoxyalkylene polyol. Suitable solvents include: methanol, 2-propanol, hexane, pentane and dioxane.

Conventional fiber lubricant additives can be used together with the fiber lubricant of the invention with or without water or conventional organic solvents. The additives can be antioxidants, antistats, emulsifiers, wetting agents, bactericides, corrosion inhibitors, defoamers, colubricants, etc. Specific additives include: butylated hydroxy toluene antioxidant, 2-ethylhexyl phosphate antistat, Twix® 20-P emulsifier, Zonyl® F5N wetting agent, phenyl mercuric acetate antistat, propargyl alcohol corrosion inhibitor, PLURAFAC® RA-40 defoamer, and mineral oil colubricants. Preferred compositions contain about 0.5 to 100 percent of the capped polyoxyalkylene polyol, 98 to 0 percent, water or organic solvent and most preferably 0.5 to 95 percent of the capped polyol, 98 to 5.0 percent water or organic solvent and the balance conventional additives in normal amounts.

In accordance with the instant invention, the capped polyoxyalkylene polyols are applied to the fibers to be lubricated in any convenient manner such as by spray or roll coating and because the fiber lubricants are fluid at ambient temperatures, these lubricants can be easily applied without dilution, by applying the fiber lubricants to the fibers immediately after the spinning operation by passing the fibers through a trough or having the fibers make contact with a "kiss" roll rotating in a trough in which the fiber lubricants are contained.

The following examples further illustrate the various aspects of the invention. Where not otherwise specified throughout this specification and claims, temperatures are indicated in degrees centigrade and parts, percentages and proportions are by weight.

EXAMPLE 1

A polyamide polymer is fed into a screw extruder and heated to 275° C. The molten polymer is pumped under pressure of approximately 1700 psig through a sand filter and then through the capillary of a spinnerette plate. Freshly extruded filaments are put through a descending spinning tower into which air of 70° F. temperature and 65 percent relative humidity is admitted. Filaments are gathered into yarn and, upon emerging from the spinning tower, coated with fiber lubricant using a finish applicator (described in U.S. Pat. No. 3,347,207). The fiber lubricant is substantially pure dimethylether of an ethylene oxide, propylene oxide block copolymer and has the following formula:

$$CH_3O(C_2H_4O)_n(C_3H_6O)_m(C_2H_4O)_nCH_3$$

wherein m plus n is sufficient to give a total molecular weight of 1700 and wherein m and n are of sufficient value whereby the weight ratio of ethylene oxide groups to propylene oxide groups is 1:1. The lubricant coating is applied to the yarn at a rate of 0.75 weight percent based on the weight of the yarn. The yarn is then wound into a package at a rate of about 2000 feet per minute. The resulting yarn is then drawn over a one inch diameter draw pin at a delivery rate of 1536 feet per minute during which time the yarn passes over a heater maintained at 175° C. The yarn is then heat cured (employing an electric heater at 150° C. for 30 minutes)

to polypropylene carpet backing with a latex binder. The dimethylether lubricant has a relatively low viscosity and is characterized by a minimum of interaction with the polyurethane elastomers used in the fiber processing machinery.

EXAMPLE 2

The procedure described in Example 1 is repeated with the exception that the substantially pure dimethylether of an ethylene oxide, propylene oxide block copolymer is replaced by a fiber lubricant solution comprising 10 percent by weight of the dimethylether of an ethylene oxide, propylene oxide block copolymer of Example 1 and 90 percent of water.

EXAMPLE 3

The procedure described in Example 1 is repeated with the exception that the dimethyl ether of an ethylene oxide propylene oxide block copolymer is replaced with the dimethyl ether of polyoxyethylene glycol.

EXAMPLE 4

The procedure of Example 1 is repeated with the exception that the substantially pure dimethylether of an ethylene oxide, propylene oxide block copolymer is replaced with a stable aqueous emulsion made by blending 58 parts by weight butyl stearate, 13 parts potassium hexyl phosphate (45 percent aqueous solution), 5 parts isopropylamine dodecyl benzene sulfonate, 2 parts 4,4'-bis-dimethyl benzyl diphenyl amine in 30 percent active dioxane solution and 22 parts of the dimethylether compound of Example 1.

EXAMPLE 5

The procedure of Example 4 is repeated with the exception that the dimethylether compound of Example 1 is replaced with a dibutyl ether having the following formula:

$$C_4H_9O(C_2H_4O)_n(C_3H_6O)_m(C_2H_4O)_nC_4H_9$$

wherein m plus n is sufficient to give a total molecular weight of 1100 and wherein m and n are of sufficient value whereby the weight ratio of ethylene oxide groups to propylene oxide groups is 1:9.

EXAMPLE 6

The procedure of Example 4 is repeated with the exception that the dimethylether compound of Example 1 is replaced with a dibenzyl ether having the following formula:

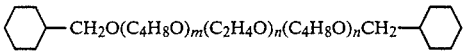

wherein m plus n is sufficient to give a total molecular weight of 1700 and wherein m and n are of sufficient value whereby the weight ratio of ethylene oxide groups to butylene oxide groups is 1:1.

EXAMPLE 7

The procedure of Example 4 is repeated with the exception that the dimethylether compound of Example 1 is replaced with a diethyl ether having the following formula:

$$C_2H_5O(C_3H_6O)_m(C_2H_4O)_n(C_3H_6O)_mC_2H_5$$

wherein m plus n is sufficient to give a total molecular weight of 5000 and wherein m and n are of sufficient value whereby the weight ratio of ethylene oxide groups to propylene oxide groups is 1:1.

EXAMPLE 8

The procedure of Example 4 is repeated with the exception that the dimethylether compound of Example 1 is replaced with a dimethyl ether having the following formula:

$$CH_3O(C_2H_4O)_n(C_4H_8O)_m(C_2H_4O)_n\,CH_3$$

wherein m plus n is sufficient to give a total molecular weight of 1700 and wherein m and n are of sufficient value whereby the weight ratio of ethylene oxide groups to propylene oxide groups is 9:1.

The embodiments of the invention in which an exclusive privilege or property is claimed are defined as follows:

1. The process of lubricating thermoplastic synthetic fibers wherein problems presented by interaction of the lubricant with the polyurethane elastomers used in fiber processing machines are eliminated or substantially reduced comprising the application to said fibers of a modified polyoxyalkylene polyol which polyol is modified by capping all of the hydroxyl groups with benzyl, aryl, substituted benzyl, or substituted aryl groups or alkyl groups having 1 to 4 carbon atoms.

2. The process of claim 1 wherein said polyoxyalkylene polyol is polyoxyethylene glycol.

3. The process of claim 1 wherein said modified polyoxyalkylene polyol is applied in an aqueous or organic solvent solution containing from about 0.5 to 100 percent by weight of said modified polyoxyalkylene polyol.

4. The process of claim 3 wherein said aqueous solution comprises 0.5 to 95. percent by weight of the modified polyoxyalkylene polyol, 98 to 5.0 percent by weight water or organic solvent, balance conventional additives in normal amounts.

5. The process of claim 4 wherein said polyoxyalkylene polyol is polyoxyethylene glycol.

6. The process of claim 1 wherein said polyoxyalkylene polyol is a copolymer of ethylene oxide and a $C_3$-$C_4$ alkylene oxide.

7. The process of claim 6 wherein said modified polyoxyalkylene polyol has a molecular weight ranging from about 500 to 15,000 and the ratio of ethylene oxide groups to $C_3$-$C_4$ alkylene oxide groups is from about 1:9 to 9:1.

8. The process of claim 7 wherein said modified polyoxyalkylene polyol is applied in an aqueous solution containing from about 0.5 to 100 percent by weight of said modified polyoxyalkylene polyol.

9. The process of claim 7 wherein said aqueous solution comprises 0.5 to 100 percent by weight of the modified polyoxyalkylene polyol, 98 to 5.0 percent by weight water or organic solvent, balance conventional additives in normal amounts.

10. The process of claim 7 wherein said $C_3$-$C_4$ alkylene oxide is propylene oxide.

11. The process of claim 10 wherein said copolymer is a heteric copolymer.

12. The process of claim 10 wherein said copolymer is a block copolymer.

13. The process of claim 7 wherein said $C_3$-$C_4$ alkylene oxide is butylene oxide.

14. The process of claim 13 wherein said copolymer is a heteric copolymer.

15. The process of claim 13 wherein said copolymer is a block copolymer.

16. A lubricated thermoplastic, synthetic fiber selected from the group consisting of polyester, nylon, poly(benzimidazole), carbon or glass fiber wherein the lubricant is one which eliminates or substantially reduces problems presented by interacting of the lubricant with the polyurethane elastomers used in the fiber processing machinery and comprises a modified polyoxyalkylene polyol which is modified by capping all hydroxyl groups with benzyl, aryl, substituted benzyl or substituted aryl groups or alkyl groups having 1 to 4 carbon atoms.

17. The product of claim 16 wherein said polyoxyalkylene polyol is polyoxyethylene glycol.

18. The product of claim 16 wherein said polyoxyalkylene polyol is a copolymer of ethylene oxide and a $C_3$-$C_4$ alkylene oxide.

19. The product of claim 18 wherein said modified polyoxyalkylene polyol has a molecular weight ranging from about 500 to 15,000 and the ratio of ethylene oxide groups to $C_3$-$C_4$ alkylene oxide groups is from about 1:9 to 9:1.

20. The product of claim 19 wherein said $C_3$-$C_4$ alkylene oxide is propylene oxide.

21. The product of claim 20 wherein said copolymer is a heteric copolymer.

22. The product of claim 20 wherein said copolymer is a block copolymer.

23. The product of claim 19 wherein said $C_3$-$C_4$ alkylene oxide is butylene oxide.

24. The product of claim 23 wherein said copolymer is a heteric copolymer.

25. The product of claim 23 wherein said copolymer is a block copolymer.

26. The process of claim 1 wherein said substituted benzyl groups and said substituted aryl groups are 1 to 10 carbon atom alkyl or halogen substituted.

27. The fiber of claim 16 wherein said substituted benzyl groups and said substituted aryl groups are 1 to 10 carbon atom alkyl or halogen substituted.

* * * * *